US005160219A

United States Patent [19]

Arlt

[11] Patent Number: 5,160,219

[45] Date of Patent: Nov. 3, 1992

[54] VARIABLE SPRING RATE RISER TENSIONER SYSTEM

[75] Inventor: Edward J. Arlt, Fort Worth, Tex.

[73] Assignee: LTV Energy Products Company, Garland, Tex.

[21] Appl. No.: 641,541

[22] Filed: Jan. 15, 1991

[51] Int. Cl.[5] ..... E02D 21/00

[52] U.S. Cl. ..... 405/195.1; 405/224.4; 166/350

[58] Field of Search ..... 405/195.1, 203, 204, 405/224.4; 114/264, 265, 256; 166/350, 359, 367, 368; 175/27, 5-7

[56] References Cited

U.S. PATENT DOCUMENTS

| | | | |
|---|---|---|---|
| 2,492,049 | 12/1949 | Krone et al. | 137/2 |
| 3,498,472 | 3/1970 | Rodgers et al. | 212/8 |
| 3,508,409 | 4/1970 | Cargile | 405/195 |
| 3,788,073 | 1/1974 | Castela et al. | 60/414 |
| 3,788,074 | 1/1974 | Castela et al. | 60/413 |
| 4,004,532 | 1/1977 | Reynolds | 405/195 X |
| 4,364,323 | 12/1982 | Stevenson | 405/195 X |
| 4,449,854 | 5/1984 | Nayler | 114/264 X |
| 4,617,998 | 10/1986 | Langner | 166/345 |
| 4,640,487 | 2/1987 | Salter | 188/380 X |
| 4,662,786 | 5/1987 | Cherbonnier | 405/195 |
| 4,729,694 | 3/1988 | Peppel | 405/195 |
| 4,759,662 | 7/1988 | Peppel | 405/195 |
| 4,883,387 | 11/1989 | Myers et al. . | |
| 4,883,388 | 11/1989 | Cherbonnier | 114/264 X |
| 4,886,397 | 12/1989 | Cherbonnier | 405/195 |
| 4,892,444 | 1/1990 | Moore | 405/195 |

OTHER PUBLICATIONS

Advertisement, "Maritime Hydraulics"; p. 5.

*Primary Examiner*—Dennis L. Taylor

*Attorney, Agent, or Firm*—Arnold, White & Durkee

[57] ABSTRACT

A number of riser tensioner systems which use passive energy storage devices, such as springs, are disclosed. The geometrical construction of these systems, along with the selection of proper spring rates for the individual springs, produces systems that have a total spring rate which varies in proportion to the stroke of the riser. Thus, the tensioning force exerted by the systems on the riser remains substantially constant throughout the range of motion of the riser.

26 Claims, 10 Drawing Sheets

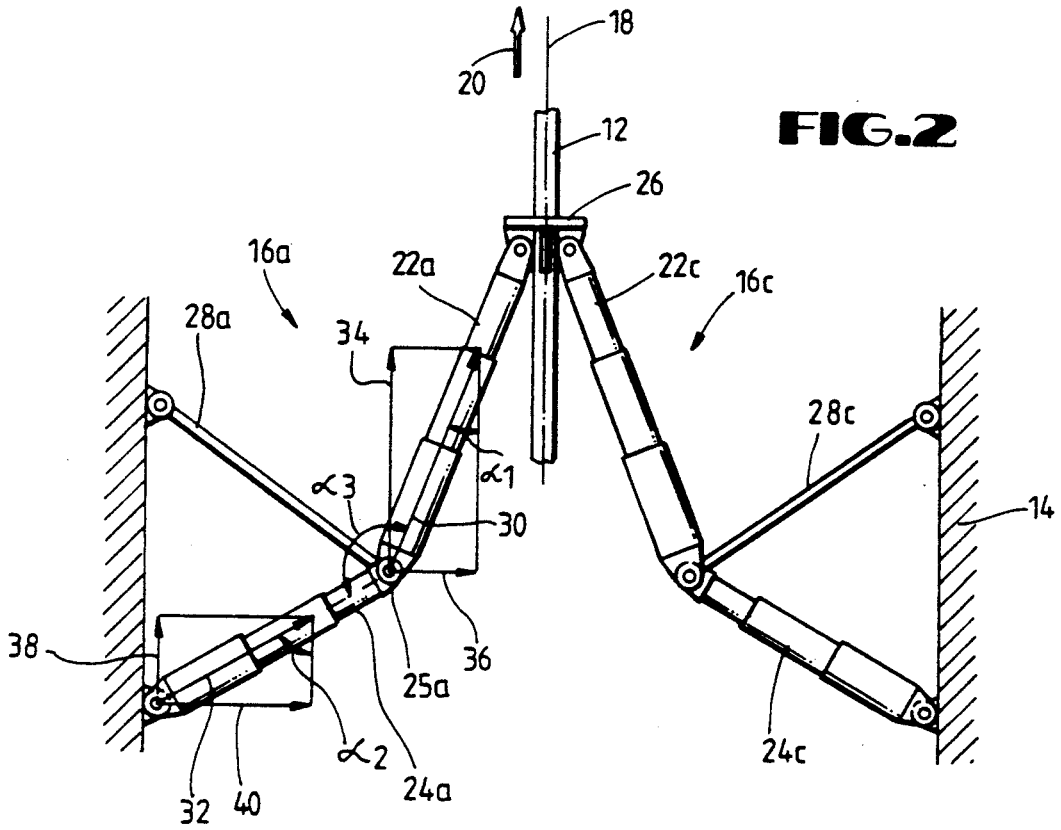
FIG.2
FIG.3
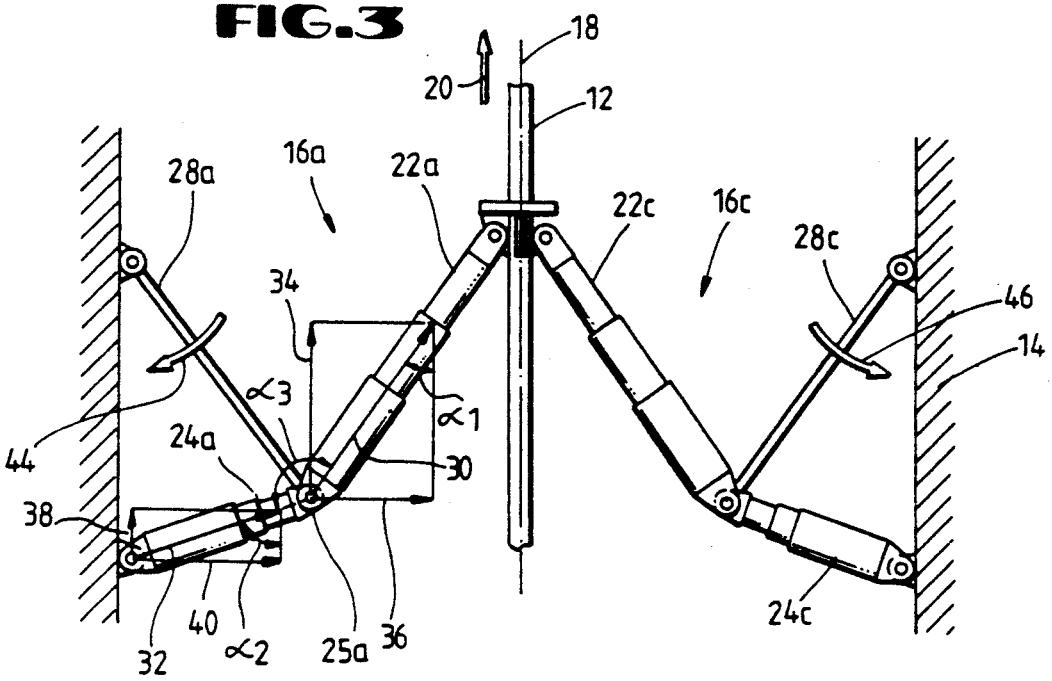

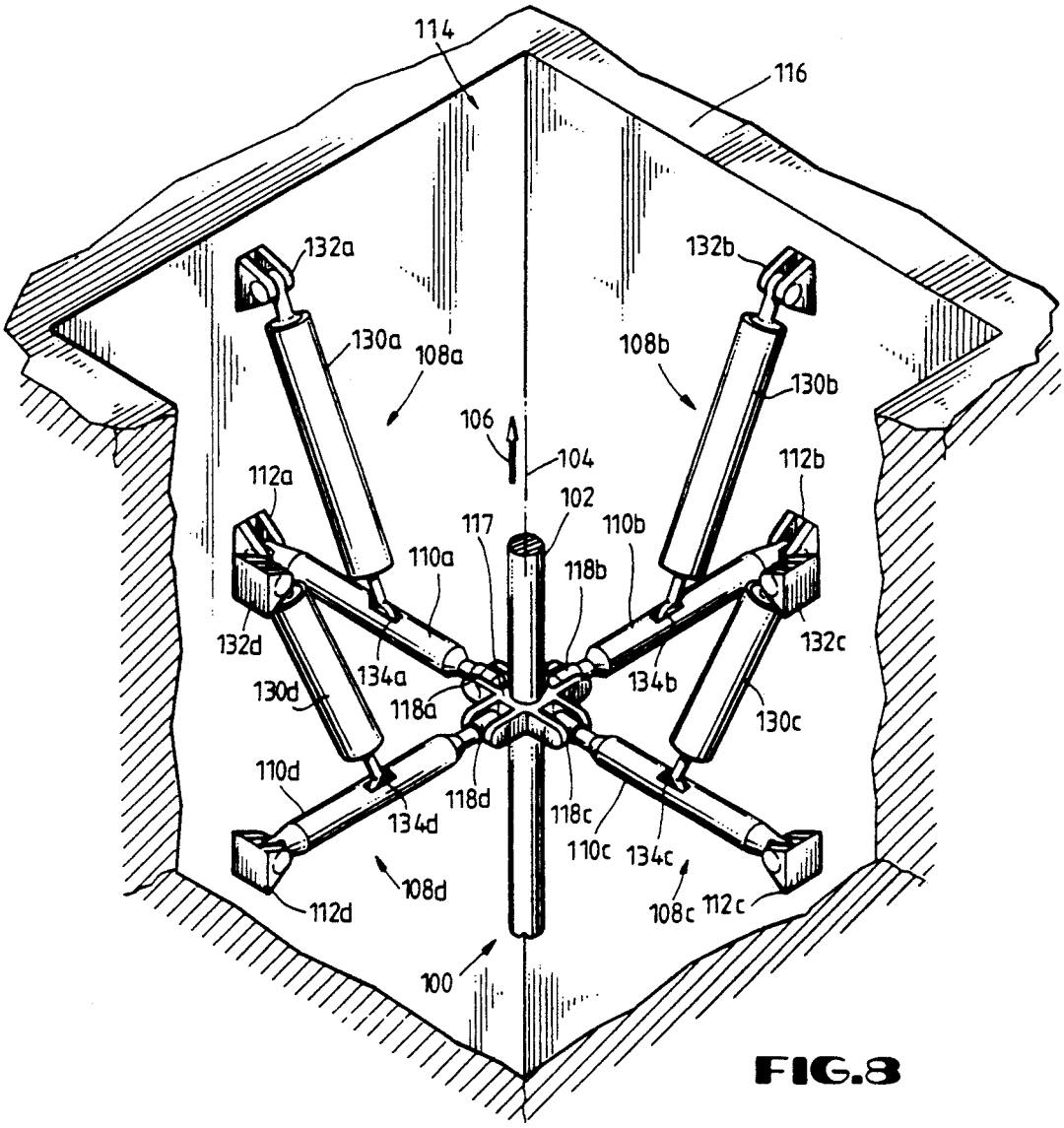
FIG.8
FIG.10
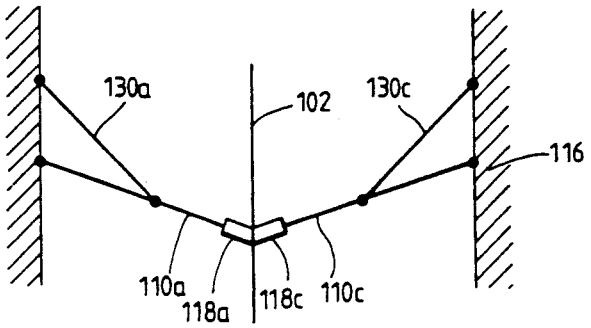

FIG. 9
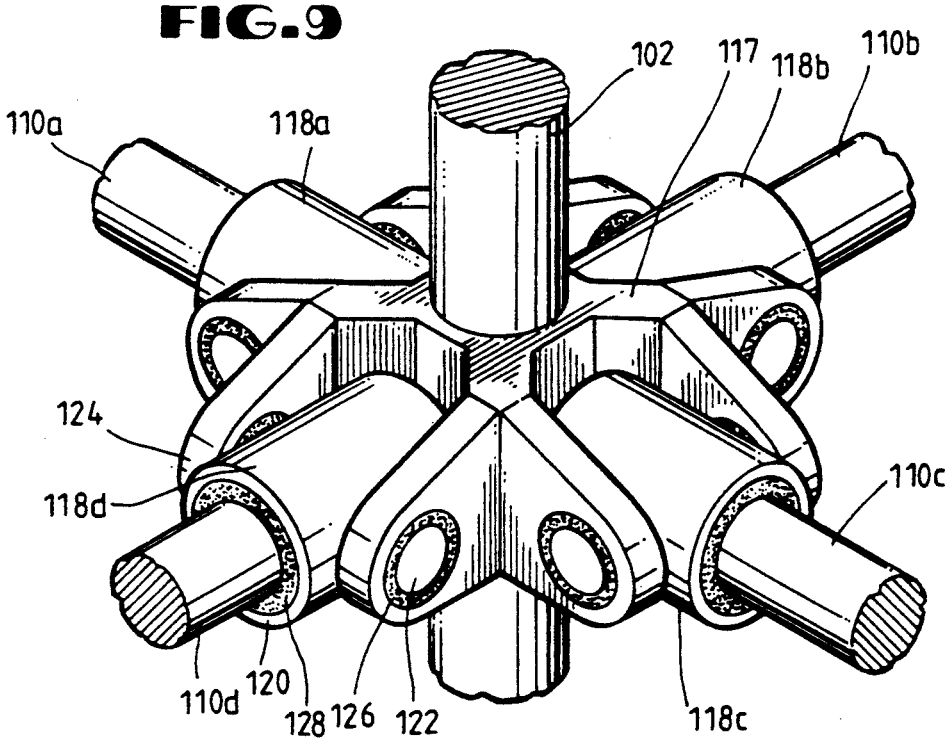
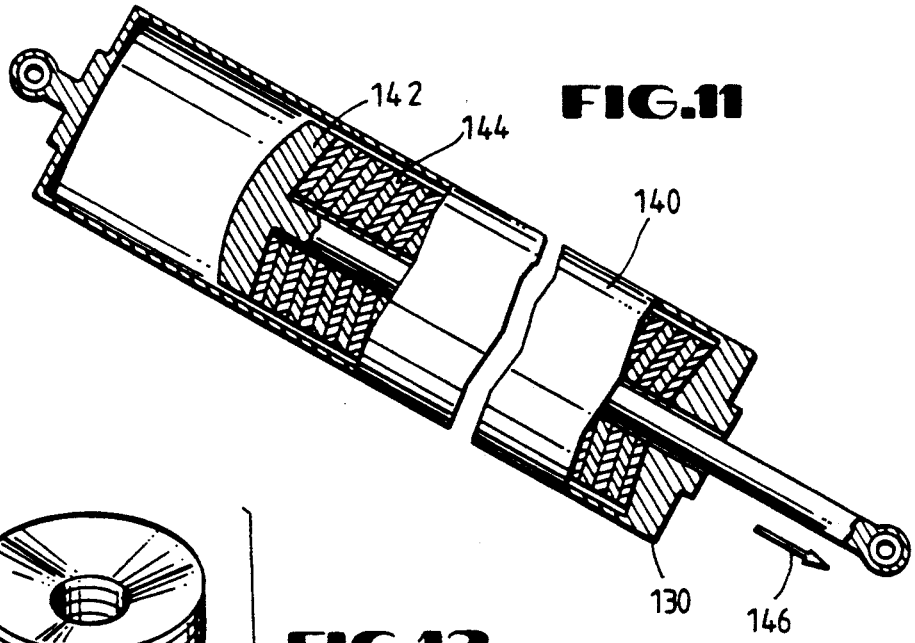
FIG. 11
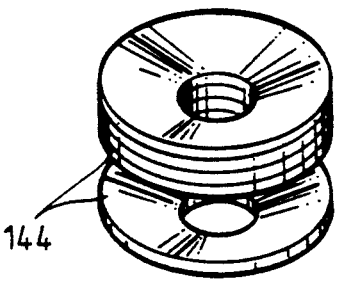
FIG. 12

FIG.14
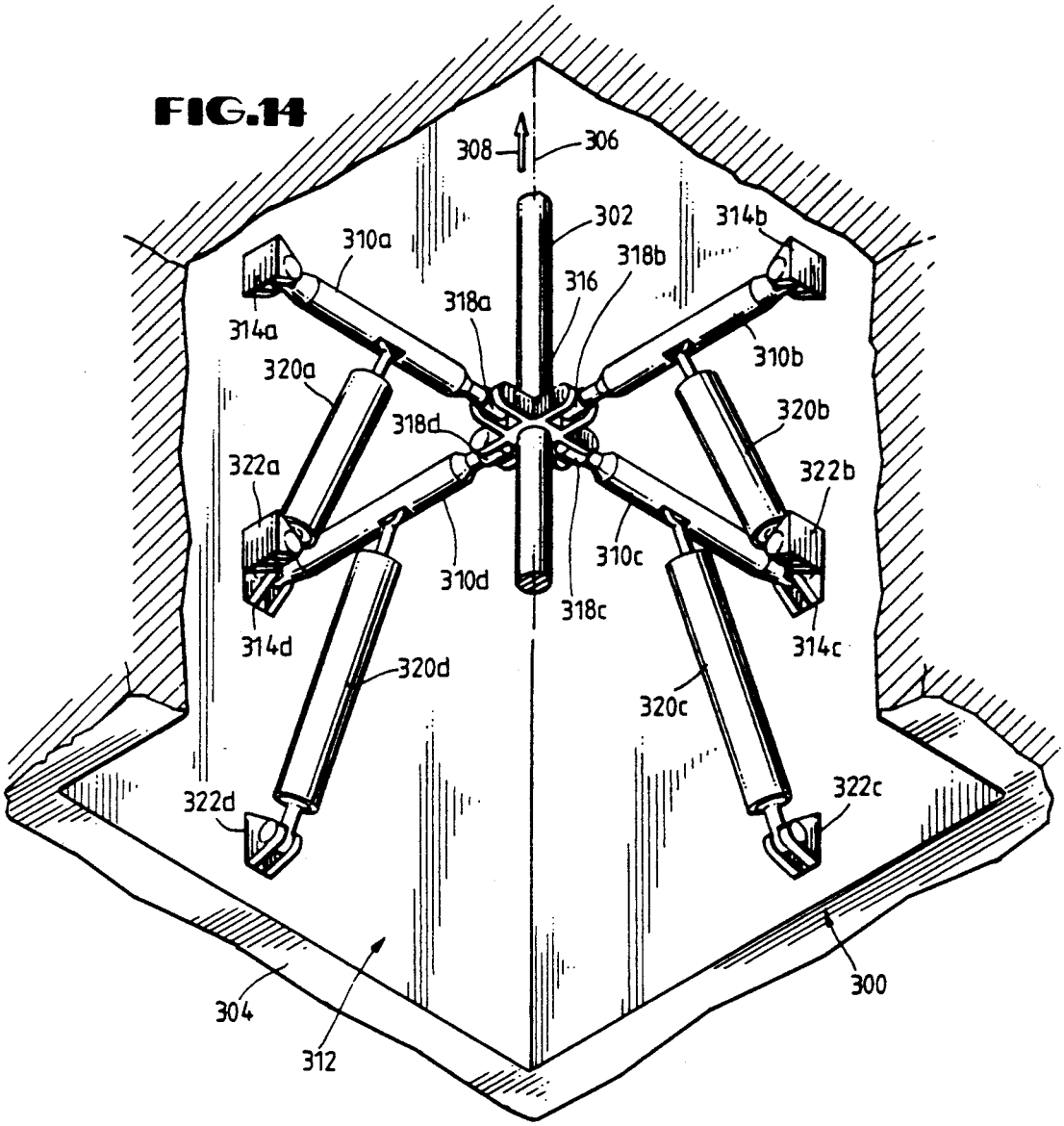
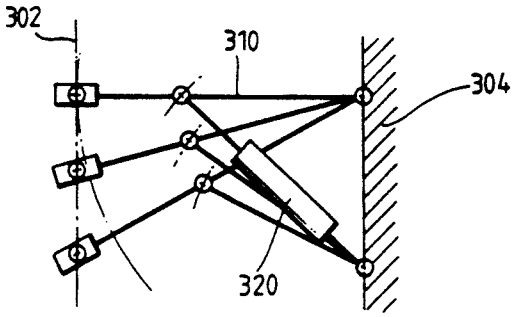
FIG.15

VARIABLE SPRING RATE RISER TENSIONER SYSTEM

BACKGROUND OF THE INVENTION

1. Field of the Invention

The present invention relates generally to riser tensioner systems for use on offshore platforms and, more particularly, to a riser tensioner system that provides a variable spring rate to maintain a substantially constant upward force on a supported riser.

2. Description of Related Art

Increased oil consumption and rising oil prices have lead to exploration drilling and production in geographic locations that were previously considered to be economically unfeasible. As is to be expected, drilling and production under these difficult conditions leads to problems that are not present under more ideal conditions. For example, an increasing number of facilities are located in deep water, offshore locations in order to tap more oil and gas reservoirs. These exploratory wells are generally drilled and then brought into production from floating platforms that produce a set of problems peculiar to the offshore drilling and production environment.

Offshore drilling and production operations require the use of pipe strings that extend from equipment on the sea floor to the floating platform. These vertical pipe strings, typically called risers, convey materials and fluids from the sea floor to the platform, and vice versa, as the particular application requires. The lower end of the riser is connected to the well head assembly adjacent the ocean floor, and the upper end usually extends through a centrally located opening in the hull of the floating platform.

As drilling and production operations progress into deeper waters, the length of the riser increases. Consequently, its unsupported weight also increases. Structural failure of the riser may result if compressive stresses in the elements of the riser exceed the metallurgical limitations of the riser material. Therefore, mechanisms have been devised in order to avoid this type of riser failure.

In an effort to minimize the compressive stresses and to eliminate, or at least postpone, structural failure, buoyancy or ballasting elements are attached to the submerged portion of the riser. These elements are usually comprised of syntactic foam elements, or of individual buoyancy or ballasting tanks, formed on the outer surface of the riser sections. Unlike the foam elements, these tanks are capable of being selectively inflated with air or ballasted with water by using the floating vessel's air compression equipment. These buoyancy devices create upwardly directed forces in the riser and, thereby, compensate for the compressive stresses created by the weight of the riser. However, experience shows that these types of buoyancy devices do not adequately compensate for the compressive stresses, or for other forces experienced by the riser.

To further compensate for the potentially destructive forces that attack the riser, the floating vessels incorporate other systems. Since the riser is fixedly secured at its lower end to the well head assembly, the floating vessel will move relative to the upper end of the riser due to wind, wave, and tide oscillations normally encountered in the offshore drilling environment. Typically, lateral excursions of the drilling vessel are prevented by a system of mooring lines and anchors, or by a system of dynamic positioning thrusters, which maintain the vessel in a position over the subsea well head assembly. Such positioning systems compensate for normal current and wind loading, and prevent riser separation due to the vessel being pushed away from the well head location. However, these positioning systems do not prevent the floating vessels from oscillating upwardly and downwardly due to wave and tide oscillations. Therefore, the riser tensioning systems on the vessels are primarily adapted to maintain an upward tension on the riser throughout the range of longitudinal oscillations of the floating vessel. This type of mechanism applies an upward force to the upper end of the riser, usually by means of a cable, a sheave, or a pneumatic or hydraulic cylinder connected between the vessel and the upper end of the riser.

However, hydraulic and pneumatic tensioning systems are large, heavy, and require extensive support equipment. Such support equipment may include air compressors, hydraulic fluid, reservoirs, piping, valves, pumps, accumulators, electric power, and control systems. The complexity of these systems necessitate extensive and frequent maintenance which, of course, results in high operating costs. For instance, many riser tensioners incorporate hydraulic actuators which stroke up and down in response to movements of the floating vessel. These active systems require a continuous supply of high pressure fluids for operation. Thus, a malfunction could eliminate the supply of this high pressure fluid, causing the system to fail. Of course, failure of the tensioner could cause at least a portion of the riser to collapse.

In an effort to overcome these problems, tensioner systems have been developed which rely on elastomeric springs. The elastomeric riser tensioner systems provide ease of installation, require minimal maintenance, and offer simple designs with few moving parts. These springs operate passively in that they do not require a constant input energy from an external source, such as a generator for instance. Moreover, the elastomeric systems do not burden the floating platform with an abundance of peripheral equipment that hydraulic systems need in order to function.

However, the elastomeric devices operate in the shear mode, whereby the rubber-like springs are deformed in the shear direction to store energy. The shear mode of operation has numerous shortcomings. For example, in the shear mode, rubber exhibits poor fatigue characteristics, which can result in sudden catastrophic failure. When numerous rubber springs are combined in series, the reliability of the system quickly deteriorates since only one flaw in the elastomeric load path can very quickly lead to catastrophic failure of the entire system.

Moreover, an ideal tensioner system provides a constant tensioning force to support the riser. While some of the complicated hydraulic systems alluded to above can be controlled to provide a substantially constant force, the simpler elastomeric devices which overcome many of the problems of the hydraulic systems do not support the riser using a constant force. Thus, changes in the force exerted on the riser in response to longitudinal excursions of the platform produce undesirable compressive stress fluctuations in the riser. These fluctuations can substantially shorted the useable life of the riser.

The present invention is directed to overcoming, or at least minimizing, one or more of the problems set forth above.

SUMMARY OF THE INVENTION

In accordance with one aspect of the present invention, a riser tensioner system is provided. The system applies a tensioning force to a riser and allows a floating platform to move within a preselected range along a longitudinal axis of the riser. The system includes a spring and lever assembly that couples the riser to the platform. The spring remains in compression throughout the range of motion between the riser and the platform. The spring also defines a spring rate for the assembly. The lever varies the magnitude of a vertical component of the spring rate in proportion to movement of the platform, so that the tensioning force remains substantially constant through the range of movement. Preferably, the system includes a plurality of such assemblies which are symmetrically disposed about the longitudinal axis of the riser.

In accordance with another aspect of the present invention, a riser tensioner system is provided. The system applies a tensioning force to a riser and allows a floating platform to move within a preselected range along a longitudinal axis of the riser. The system includes a spring which has a first end and a second end, and which has a preselected spring rate. The first end is adapted to be pivotally coupled to the platform. The system also includes a lever which has a first end and a second end. The first end of the lever is adapted to be pivotally coupled to the platform, and the second end of the lever is adapted to be pivotally coupled to the riser. The second end of the spring is pivotally coupled to a preselected location on the lever, thus forming an angle between a longitudinal axis of the spring and the longitudinal axis of the riser. The angle determines a vertical magnitude of the spring rate. During movement between the riser and the platform, the lever varies the vertical magnitude of the spring rate in proportion to the movement, so that the tensioning force remains substantially constant through the range of movement.

In accordance with yet another aspect of the present invention, there is provided a method for applying a substantially constant tensioning force to a riser while allowing limited vertical movement between the riser and a floating platform. The method includes the step of coupling at least one spring between the riser and the platform to form an angle between a longitudinal axis of the spring and a longitudinal axis of the riser. The spring has a preselected spring rate having a vertical magnitude determined by the angle. The method also includes the step of decreasing the vertical magnitude of the spring rate in proportion to the limited vertical movement by increasing the angle when the limited vertical movement causes the spring to compress.

BRIEF DESCRIPTION OF THE DRAWINGS

Advantages of the invention will become apparent upon reading the following detailed description and upon reference to the drawings in which:

FIG. 2 illustrates a side view taken along line 2—2 in FIG. 1 while the riser tensioner system is in an undeflected state;

FIG. 3 illustrates a side view taken along line 2—2 in FIG. 1 while the riser tensioner system is in a deflected state;

FIG. 8 is a perspective view of an alternate riser tensioner system in accordance with the present invention;

FIG. 9 is a perspective view of a motion compensation bearing assembly that couples levers to the riser;

FIG. 10 is a side view of a portion of the riser tensioner system illustrated in FIG. 8;

FIG. 11 is a partially cutaway view of an elastomeric spring for use with a riser tensioner system in accordance with the present invention;

FIG. 12 is a perspective view of a conically shaped elastomeric pad for use in the spring illustrated in FIG. 11;

FIG. 14 is a perspective view of yet another alternate riser tensioner system in accordance with the present invention;

FIG. 15 is a diagrammatic view of the motion of one arm of the system illustrated in FIG. 14;

Figure 1:
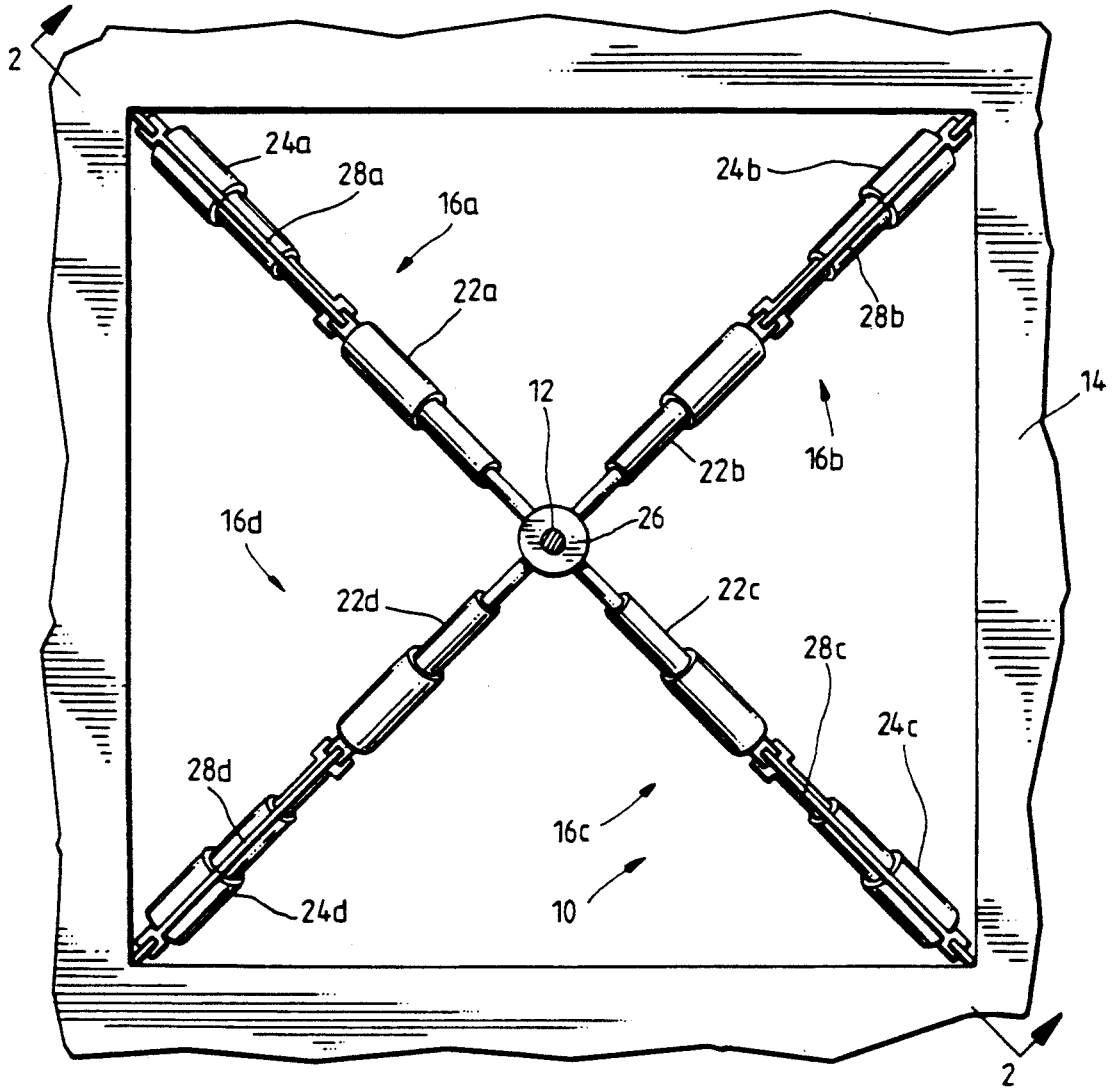
FIG. 1 illustrates a top view of a riser tensioner system in accordance with the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF THE PREFERRED EMBODIMENTS

Before discussing the specific structure illustrated in the drawings, it should be noted that by following the teachings disclosed herein a wide variety of riser tensioner systems that maintain a substantially constant tensioning force may be designed. Indeed, several systems are described herein. Preferably, each system uses elastomeric or metal spring devices that operate in the compression mode. When such devices operate in the compression mode, they offer inherent advantages such as extremely long fatigue life and fail-safe operation. However, compression-loaded spring devices tend to get stiffer as the spring deflects. The force produced by a spring as it deflects is given by the following equation:

$$F=xk_c, \quad \text{(eq. 1)}$$

where F equals the force applied to the spring, x equals the deflection of the spring, and $k_c$ equals the compression spring rate of the spring. Therefore, for the system to maintain a substantially constant force on the riser as the platform moves, the collective spring rates of the tensioner devices vary inversely proportionally with respect to the deflection of the system as the system deflects. In other words, as the riser strokes and compresses the spring tensioner devices, the spring rate of the system becomes softer, in accordance with the above equation.

Turning now to the drawings and referring initially to FIG. 1, a riser tensioner system is illustrated and generally designated by a reference numeral 10. To avoid confusion, similar elements of the riser tensioner system 10 will be labeled with like reference numerals. The system 10 connects a riser pipe 12 to a floating platform 14, and allows the platform 14 to move in a direction perpendicular to the plane defined by the drawing sheet relative to the riser 12. The range of movement of the platform 14 with respect to the riser 12 is commonly referred to as the "riser stroke." Ideally, the system 10 minimizes the compressive stresses in the riser 12 as the riser strokes by applying a substantially constant force to maintain tension on the riser 12.

The structural description of the preferred embodiment of the system 10 will be facilitated by referring to FIGS. 1-3. Preferably, the system 10 includes four tensioning assemblies or arms 16*a*, 16*b*, 16*c*, and 16*d*, which are advantageously positioned symmetrically about the riser 12. In order to minimize the compressive stress in the riser 12, each arm 16 exerts a force along the longitudinal axis 18 of the riser 12 in the direction of the arrow 20. As will be explained hereinafter, each arm 16 maintains a relatively constant force in the direction of the arrow 20 as the riser 12 strokes to substantially prevent fluctuations in the downward compressive force that the riser 12 exerts on itself.

FIGS. 1-3 illustrate a riser tensioner system 10 that, in a preferred embodiment, reduces the spring rate in the direction of the arrow 20 as the riser 12 strokes in order to maintain a substantially constant force on the riser 12 in the direction of the arrow 20. Each arm 16*a*-16*d* includes an upper spring 22*a*, 22*b*, 22*c*, 22*d* and a lower spring 24*a*, 24*b*, 24*c*, 24*d*. One end of each of the upper springs 22*a*-22*d* is pivotally connected to a mounting bracket 26. The mounting bracket 26 is fixedly coupled to the outer cylindrical surface of the riser 12. The other end of each of the upper springs 22*a*-22*d* is pivotally connected to one end of its respective lower spring 24*a*-24*d* to form respective junctions 25*a*, 25*b*, 25*c*, 25*d*. The other end of each lower spring 24*a*-24*d* is pivotally connected to the platform 14 by a respective mounting bracket. As the riser 12 strokes, each of the springs 22*a*-24*d* rotates about the periphery of a circle which is defined by the movement of intermediate levers 28*a*, 28*b*, 28*c*, 28*d*. One end of each lever 28*a*-28*d* is pivotally connected to the respective junction 25*a*-25*d* of the upper and lower springs, and the other end of each lever 28*a*-28*d* is pivotally connected to the platform 14 at a point on the platform 14 higher than that of the connection of the lower springs 24*a*-24*d*.

For the purposes of this discussion, we will assume that FIG. 2 illustrates a portion of the system 10 in its undeflected state. In other words, the springs 22*a*-24*d* are in a state of pre-loaded compression only. Since the system 10 operates in a compression mode throughout the range of vertical motion allowed by the system 10, this position defines one limit of the stroke range where the platform 14 has moved downwardly with respect to the riser 12. In this state, the spring rate $k_1$ of the upper spring 22*a* is defined by the vector 30, and the spring rate $k_2$ of the lower spring 24*a* is defined by the vector 32. Of course, it should be understood that since the system 10 is symmetrical, similar vectors could be drawn for each of the upper and lower springs 22*a*-24*d*. The vector 30 may be separated into a vertical component 34, which is parallel to the longitudinal axis 18, and a horizontal component 36, which is perpendicular to the longitudinal axis 18. Similarly, the vector 32 may be separated into a vertical component 38, which is parallel to the longitudinal axis 18, and a horizontal component 40, which is perpendicular to the longitudinal axis 18.

It may be readily perceived that only the vertical components 34 and 38 of each spring vector $k_1$ and $k_2$ contribute to the vertical spring rate of the system 10. The horizontal vector components 36 and 40 contribute nothing toward resisting the vertical excursions between the riser 12 and the platform 14; they merely have the effect of keeping the riser 12 centered within the opening of the platform 14.

FIG. 3 illustrates the system lo in a compressed state where the platform 14 has moved upwardly with respect to the riser 12 in the direction of the arrow 20. It should be noticed that as the platform 14 moves upwardly with respect to the riser 12, the levers 28*a*-28*d* rotate in the direction of the arrows 44 and 46. In response to this rotation, the angle $\alpha_1$, between the vector 30 and the longitudinal axis 18, and the angle $\alpha_2$, between the vector 32 and the longitudinal axis 18, increases. Moreover, as long as the angle $\alpha_3$, between the vector 30 and the vector 32, remains less than 180°, the springs 22 and 24 compress in response to the upward movement of the platform 14.

It should be noticed that as the angles $\alpha_1$ and $\alpha_2$ increase, the magnitudes of the vertical vectors 34 and 38 decrease while the magnitudes of the horizontal vectors 36 and 40 increase. Therefore, if we consider the system 10 as a spring which exerts a force in the direction of the arrow 20, and if we consider that the position of the platform 14 with respect to the riser 12 corresponds to the deflection of the spring defined by the system 10, it can be seen that as the movement of the platform 14 compresses the system 10, the vertical component of the spring rate of the system 10, defined by the vertical vectors 34 and 38 for each of the arms 16*a*-16*d*, decreases. Thus, the length of the levers 28*a*-28*d*, and the length and spring rates of the springs 22*a*-24*d*, are selected such that the vertical spring rate of the system 10 decreases proportionally to the upward movement of the platform 14 in order to keep the force in the direction of the arrow 20 substantially constant.

Figure 4:
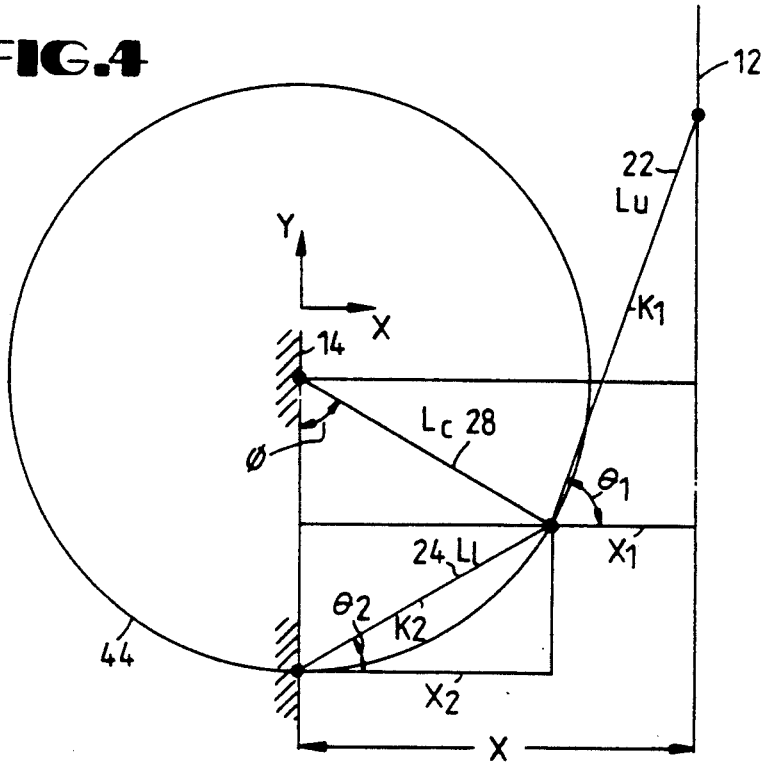
FIG. 4 is a diagrammatic illustration of one riser tensioner arm being connected between a floating platform and a riser while the arm is in an undeflected state.
Figure 5:
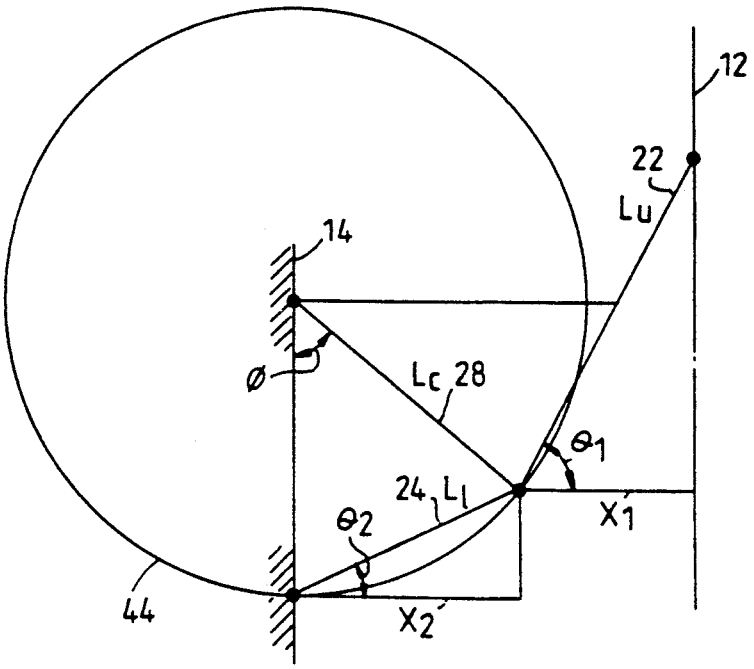
FIG. 5 is a diagrammatic illustration of one riser tensioner arm being connected between the floating platform and the riser after the arm has been deflected by 15%.
Figure 6:
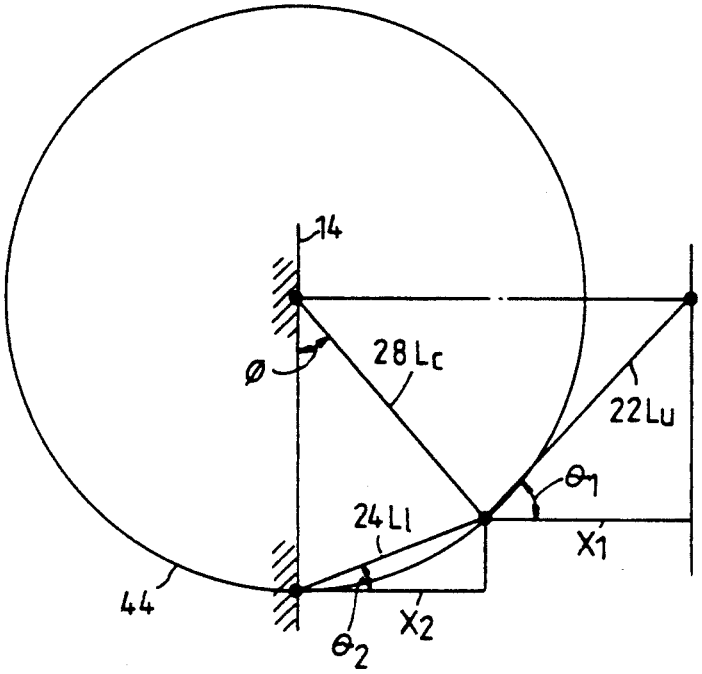
FIG. 6 is a diagrammatic illustration of one riser tensioner arm being connected between the floating platform and the riser after the arm has been deflected by 30%.
Figure 7:
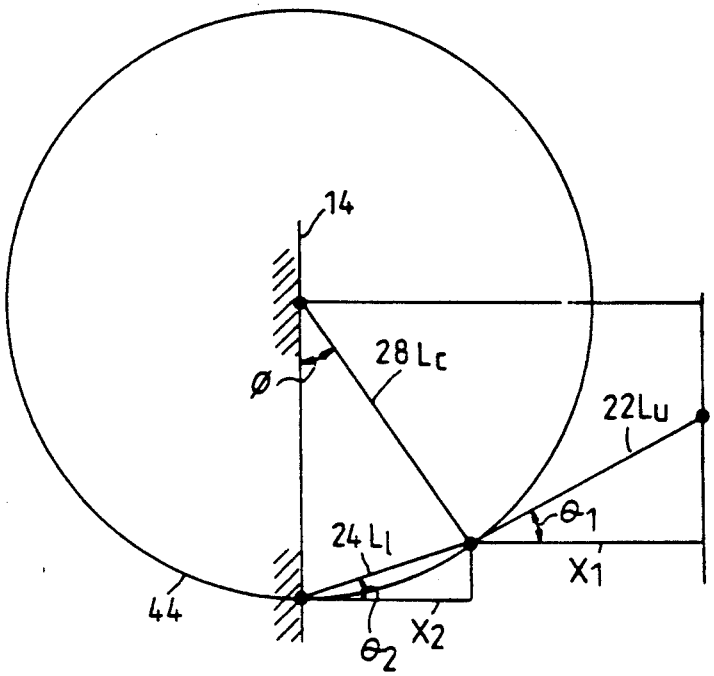
FIG. 7 is a diagrammatic illustration of one riser tensioner arm being connected between the floating platform and the riser after the arm has been deflected by 40%.

FIGS. 4-7 diagrammatically illustrate basic parameters of one arm 16 of the system 10 as the riser 12 strokes. The components of an arm 16 are represented by the appropriately numbered lines 22, 24 and 28, which represent an upper spring, a lower spring, and a lever, respectively. FIG. 4 illustrates the springs 22 and 24 with no deflection (except for the pre-loaded deflection), FIG. 5 illustrates the springs as being deflected by 15%, FIG. 6 illustrates the springs as being deflected by 30%, and FIG. 7 illustrates the springs as being deflected by 40%. As will become apparent in the following discussion, the magnitude of the vertical component of the spring rate of the system 10 decreases as the system 10 deflects in response to the vertical excursions between the riser 12 and the platform 14.

For purposes of this example, the length $L_c$ of the lever 28 is 2.0 units, the length $L_u$ of the upper spring 22 is 3.0 units, and the length $L_1$ of the lower arm 24 is 2.0 units. Since the length $L_c$ of the lever 28 and the length $L_1$ of the lower spring 24 are the same, they form an isosceles triangle with the platform 14. Moreover, in this example, the angle $\Theta$ formed between the platform 14 and the lever 28 is initially 60°, so the lever 28 and the lower spring 24 form an equilateral triangle with all inner angles being 60°. The circle 44 represents the path which the lever 28 follows as the riser 12 strokes. The line X represents the horizontal distance between the riser 12 and the platform 14. The line $X_1$ represents the distance between the junction 25 and the riser 12, the line $X_2$ represents the horizontal distance between the platform 14 and the junction 25. The horizontal distance X is 2.75 units. The angle $\Theta_1$ represents the angle between the upper spring 22 and the line $X_1$. The angle $\Theta_2$ represents the angle between the lower spring 24 and the line $X_2$. By stepping through the following equations the magnitude of the vertical component of the spring rate, ky, for an arm 16 is calculated.

First, the lengths of $X_1$ and $X_2$ are calculated as follows:

$$X_2 = L_c \sin \Theta = 1.732; \textit{ and,}$$

$$\textit{if } X_1 + X_2 = 2.75, \textit{ then } X_1 = 1.018.$$

Then, the angles $\Theta_1$ and $\Theta_2$ are calculated as follows:

$$\cos \Theta_2 = 1.732/2.0 = 0.866, \textit{ so } \Theta_2 = 30°; \textit{ and}$$

$$\cos \Theta_1 = 1.018/3.0 = 0.339, \textit{ so } \Theta_1 = 70.16°.$$

Next, the y-component of each spring rate vector $k_1$ and $k_2$ is calculated as follows:

$$k_1y = k_1 \sin 70.16 = 0.94\ k_1; \textit{ and}$$

$$k_2y = k_2 \sin 30 = 0.50\ k_2.$$

Finally, the total spring rate in the vertical direction for an arm 16 may be represented by:

$$1/ky = 1/0.94\ k_1 + 1/0.50\ k_2.$$

FIG. 5 illustrates the arm 16 where the platform 14 has moved relative to the riser 12 to deflect each spring 22 and 24 by 15%. Therefore, the length $L_u$ of the upper spring 22 is 2.55 units, and the length $L_1$ of the lower spring is 1.7 units.

First, the angle $\Theta$ is calculated as follows:

$$\sin \Theta/2 = L_1/2L_c = 1.7/2(2.0) = 0.425;$$

$$\textit{therefore, } \Theta/2 = 25.15°, \textit{ so } \Theta = 50.3°.$$

The lengths of $X_1$ and $X_2$ are calculated as follows:

$$X_2 = L_c \sin \Theta = 1.538; \textit{ and,}$$

$$\textit{if } X_1 + X_2 = 2.75, \textit{ then } X_1 = 1.211.$$

Then, the angles $\Theta_1$ and $\Theta_2$ are calculated as follows:

$$\cos \Theta_2 = 1.538/1.7 = 0.905, \textit{ so } \Theta_2 = 25.21°; \textit{ and}$$

$$\cos \Theta_1 = 1.211/2.55 = 0.475, \textit{ so } \Theta_1 = 61.65°.$$

Next, the y-component of each spring rate vector $k_1$ and $k_2$ is calculated as follows:

$$k_1y = k_1 \sin 61.65 = 0.88\ k_1; \textit{ and}$$

$$k_2y = k_2 \sin 25.21 = 0.425\ k_2.$$

Finally, the total spring rate in the vertical direction for the arm 16 may be represented by:

$$1/ky = 1/0.88\ k_1 + 1/0.425\ k_2.$$

FIG. 6 illustrates the arm 16 where the platform 14 has moved relative to the riser 12 to deflect each spring 22 and 24 by 30%. Therefore, the length $L_u$ of the upper spring 22 is 2.1 units, and the length $L_1$ of the lower spring is 1.4 units.

First, the angle $\Theta$ is calculated as follows:

$$\sin \Theta/2 = L_1/2L_c = 1.4/2(2.0) = 0.35;$$

$$\textit{therefore, } \Theta/2 = 20.48°, \textit{ so } \Theta = 40.97°.$$

The lengths of $X_1$ and $X_2$ are calculated as follows:

$$X_2 = L_c \sin \Theta = 1.311; \textit{ and,}$$

$$\textit{if } X_1 + X_2 = 2.75, \textit{ then } X_1 = 1.438.$$

Then, the angles $\Theta_1$ and $\Theta_2$ are calculated as follows:

$$\cos \Theta_2 = 1.311/1.4 = 0.936, \textit{ so } \Theta_2 = 20.5°; \textit{ and}$$

$$\cos \Theta_1 = 1.438/2.1 = 0.685, \textit{ so } \Theta_1 = 46.78°.$$

Next, the y-component of each spring rate Vector $k_1$ and $k_2$ is calculated as follows:

$$k_1y = k_1 \sin 46.78 = 0.73\ k_1; \textit{ and}$$

$$k_2y = k_2 \sin 20.5 = 0.35\ k_2.$$

Finally, the total spring rate in the vertical direction for the arm 16 may be represented by:

$$1/ky = 1/0.73\ k_1 + 1/0.35\ k_2.$$

FIG. 7 illustrates the arm 16 where the platform 14 has moved relative to the riser 12 to deflect each spring 22 and 24 by 40%. Therefore, the length $L_u$ of the upper spring 22 is 1.8 units, and the length $L_1$ of the lower spring is 1.2 units.

First, the angle $\Theta$is calculated as follows:

$$\sin \Theta/2 = L_1/2L_c = 1.2/2(2.0) = 0.30;$$

$$\text{therefore, } \Theta/2 = 17.45°, \textit{ so } \Theta = 34.91°.$$

The lengths of $X_1$ and $X_2$ are calculated as follows:

$$X_2 = L_c \sin \Theta = 1.144; \textit{ and,}$$

$$\text{if } X_1+X_2=2.75, \text{ then } X_1=1.606.$$

Then, the angles $\Theta_1$ and $\Theta_2$ are calculated as follows:

$$\cos \Theta_2=1.144/1.2=0.953, \text{ so } \Theta_2=17.5°; \text{ and}$$

$$\cos \Theta_1=1.606/1.8=0.892, \text{ so } \Theta_1=26.85°.$$

Next, the y-component of each spring rate vector $k_1$ and $k_2$ is calculated a follows:

$$k_1y=k_1 \sin 26.85=0.45\ k_1; \text{ and}$$

$$k_2y=k_2 \sin 17.5=0.30\ k_2.$$

Finally, the total spring rate in the vertical direction for the arm 16 may be represented by:

$$1/ky=1/0.45\ k_1+1/0.30\ k_2.$$

As can be seen, as the riser 12 strokes downwardly relative to the platform 14, the springs 22 and 24 compress and rotate to become more horizontally oriented. Thus, the vertical component of the spring rate decreases, as shown mathematically by the calculations. The vertical component of the spring rate of the system 10 is calculated by merely summing the vertical components of the spring rates for each arm 16.

To design the system 10 to provide a substantially constant force in the direction of the arrow 20 as the riser 12 strokes, the spring rates $k_1$ and $k_2$ for the upper and lower springs 22 and 24, respectively, are selected so that the magnitude of the vertical component of the spring rate for the system 10 varies directly with and inversely proportional to the deflection of the system 10 in accordance with equation 1. For instance, the position x of the riser 12 in FIG. 4 is determined by the deflection of the springs 22 and 24 of the system 10 caused by the preload. The subsequent positions of the system 10 shown in FIGS. 5–7 can be easily determined by simple geometric calculations. Thus, the deflection of the system 10 and the spring rates of the springs 22 and 24 are selected, by using the calculations for FIGS. 4–7 for example, to satisfy a constant force F for equation 1. (Refer to FIGS. 11 and 12 and the accompanying text for a discussion regarding the selection of spring rates.)

FIGS. 8–10 illustrate an alternate embodiment of a variable spring rate riser tensioner system which is generally designated by a reference numeral 100. As before, similar elements of the system 100 will be labeled with like reference numerals. The system 100 applies a substantially constant upward Vertical force to a riser 102 along the longitudinal axis 104 of the riser, i.e., generally in the direction of the arrow 106, in order to minimize compressive stress fluctuations in the riser 102.

The system 100 preferably includes four tensioning assemblies or arms 108*a*, 108*b*, 108*c*, 108*d* which are symmetrically disposed about the longitudinal axis 104 of the riser 102. Each arm 108*a*–108*d* includes a lever 110*a*, 110*b*, 110*c*, 110*d*. The radially outward end of each lever 110*a*–110*d*, is pivotally connected to a respective inner wall of the opening 114 in the floating platform 116 by a respective mounting bracket 112*a*, 112*b*, 112*c*, 112*d*. The radially inward ends of each of the levers 110*a*–110*d* are pivotally connected to a mounting bracket 117, which in turn is fixedly connected to the outer periphery of the riser 102.

If we assume fc. a moment that the system 100 included only the lever arm 110*a*, it is easy to visualize that the lever arm 110*a* would pivot about each of its ends as the floating platform 116 moves upwardly relative to the riser 102. As a result, the angle between the lever 110*a* and the riser 102 would decrease, as would the horizontal distance between the inner wall of the opening 114 and the riser 102. Therefore, if the system 100 contains two or more symmetrically disposed levers 110, it can be appreciated that the opposing forces generated as the platform 116 attempted to move vertically relative to the riser 102 would cause unwanted stress in, and possibly destruction of, some of the components of the system 100.

To resolve this problem, the radially inward end of each of the levers 110*a*–110*d* are pivotally coupled to the mounting bracket 117 via a respective motion compensation bearing 118*a*, 118*b*, 118*c*, 118*d*. Each motion compensation bearing 118*a*–118*d* allows the radially inward end of each of the levers 110*a*–110*d* to move axially in response to vertical excursions between the platform 116 and the riser 102. Thus, when the angle between the riser 102 and the levers 110*a*–110*d* is 90°, a maximum portion of each radially inward end of the levers 110*a*–110*d* resides within its respective motion compensation bearing 118*a*–118*d*, and the levers 110*a*–110*d* are at their shortest length. However, as the platform 116 moves relatively to the riser 102 such that the angle between the riser 102 and the levers 110*a*–110*d* decreases, the levers 110*a*–110*d* lengthen by virtue of the fact that a portion of the radially inward end of each of the levers 110*a*–110*d* slides axially outwardly from within the respective motion compensation bearing 118*a*–118*d*.

FIG. 9 illustrates the motion compensation bearings 118*a*–118*d* in greater detail. For ease of illustration, the motion compensation bearings 118*a*–118*d* will be described with respect to the motion compensation bearing 118*d* with the understanding that all of the motion compensation bearings 118*a*–118*d* are similarly constructed. The motion compensation bearing 118*d* includes a tubular outer structure 120 which is coaxially aligned with the radially inward end of the lever 110*d*. Preferably, pins 122 are attached to the radially outward surface of the tube 120 at diametrically opposed positions. Therefore, when the tube 120 is placed within the U-shaped bracket 124 of the mounting bracket 117, the pins 122 extend through each of the opposed arms of the U-shaped bracket 124. The pins 122 allow the motion compensation bearing 118*d* to pivot relative to the U-shaped bracket 124. Preferably, the pins 122 are located at the axial center of the tube 120 in order to minimize the bending movements introduced into the tube 120 as the motion compensation bearing 118*d* pivots. Each of the pins 122 pivot on a bearing 126 which is disposed between the pin 122 and the U-shaped bracket 124. Advantageously, the motion compensation bearing 118*d* exhibits only limited pivotal movement within the U-shaped bracket 124, so that the excursions of the lever 110*d* are limited to a predetermined angular range. It should also be noted that the motion compensation bearing 118*d* includes a molded bearing 128 which deforms in shear as the lever 110*d* moves axially (i.e., radially with respect to the riser 102) in response to the stroke of the riser 102. Therefore, the molded bearing 128 not only allows the lever 110*d* to move axially, but also exerts a radially inward force which centers the system 100 so that the levers 110a–110d are perpendicular to the longitudinal axis 104.

It should also be noted that in order to obtain maximum benefit of the extended length provided by the motion compensation bearings 118a–118d, the motion compensation bearings 118a–118d should be mounted at the riser pipe end of the levers 110a–110d, rather than at the radially outward ends of the levers. Mounting the motion compensation bearings 118a–118d near the walls to which the levers 110a–110d connect offers no positive mechanical advantage since the length of the levers between the riser 102 and the ends of the springs 130a–130d would remain of fixed length. In other words, the downward force exerted by the riser 102 along the portion of the levers 110a–110d from the riser 102 to the respective slots 134a–134d would not be further multiplied by a lengthening lever arm. Furthermore, mounting the motion compensation bearings near the radially outward ends of the levers 110a–110d, in view of the orientation of the springs 130a–130d, would likely result in the destruction of the motion compensation bearings due to the large forces introduced by the horizontal components of the springs 130a14 130d.

Referring again to FIG. 8, the system 100 further includes a plurality of springs 130a, 130b, 130c, 130d. One end of each of the springs 130a–130d is connected to the inner walls of the opening 114 in the platform 116 by a respective mounting bracket 132a, 132b, 132c, 132d. The other end of each of the springs 130a–130d is pivotally connected at predetermined point along each of the respective levers 110a–110d. Preferably, each of the levers 110a–110d includes a slot 134a, 134b, 134c, 134d which has a pin (not shown) extending therethrough. As the platform 116 moves in the direction of the arrow 106 relative to the riser 102, each of the levers 110a–110d pivot downwardly, and each of the springs 130a–130d extend. Of course, be easily visualized, that as the platform 116 moves in the direction opposite arrow 106 with respect to the riser 102, the levers 110a–110d will pivot upwardly, and 130a–130d will retract.

Advantageously, each of the springs 130a–130d remains in compression throughout the range of the system 100. In other words, from the minimum stroke of the riser 102 to the maximum stroke of the riser 102, the springs 130a–130d remain compressed. Referring briefly to FIG. 11, an exemplary spring 130 is illustrated. The spring 130 includes a cylindrical canister 140 having a cylindrical plunger 142 being axially moveable therein. A number of round pads 144 are stacked within the canister 140 between the end of the canister 140 and the plunger 142. Therefore, as the plunger 142 moves in the direction of the arrow 146, the pads 144 increasingly compress. Generally, the spring rate of the spring 130 is determined by the number of the pads 144, the shape of the pads 144, and the material from which the pads 144 are made. For example, to experimentally select a spring rate for one of the systems mentioned herein, pads 144 may be added to or taken from the springs until the vertical component of the spring rate for the particular system varies directly with and inversely proportional to the deflection of the system.

Furthermore, the shape of all or some of the pads 144 may be selected to alter the spring rate of a spring. As illustrated in FIG. 12, each pad 144 has a circular periphery, but the upper and lower surfaces are slightly conically shaped. Typically, the conically shaped pad 144 offers a softer spring rate than a flat pad, and also offers greater column stability when a number of conical pads 144 are stacked one on top of another. It should also be noted that by properly selecting the shape, size and composition of the pads 144, a spring having a variable spring rate may be obtained. While the systems discussed herein vary the spring rate by pivoting springs with respect to a riser, a spring having a variable spring rate could be used in a system, similar to one disclosed herein, for maintaining a substantially constant force F on a riser.

Referring to FIG. 10, it should be noticed that as the platform 116 moves upwardly relative to the riser 102, the springs 130a–130d not only compress more, but also tend to rotate to a more vertical position. In other words, the angle between the springs 130a–130d and the inner walls of the opening 114 of the platform decreases. Therefore, in contrast to the system 10, the springs 130a–130d of the system 100 have vertical components of a spring rate vector which tends to increase as the springs compresses rather than decrease. However, this is offset by the greater mechanical advantage gained by the levers 110a–110d as they increase in length as the riser 102 strokes downwardly. Thus, although the spring force in the vertical direction increases, the amount of force exerted by the springs 130a–130d tending to rotate the levers 110a–110d upwardly decreases because the angle between the fixed portion of the levers 110a–110d and the springs 130a–130d decreases. Moreover, it is easy to visualize that as the platform 116 moves upwardly, the length of the levers 110a–110d from the slots 134a–134d to the mounting bracket 117 increases. Thus, the downward force exerted by the riser 102 works along a longer lever arm which compensates for the increasing difficulty of further compressing the springs 130a–130d.

Figure 13:
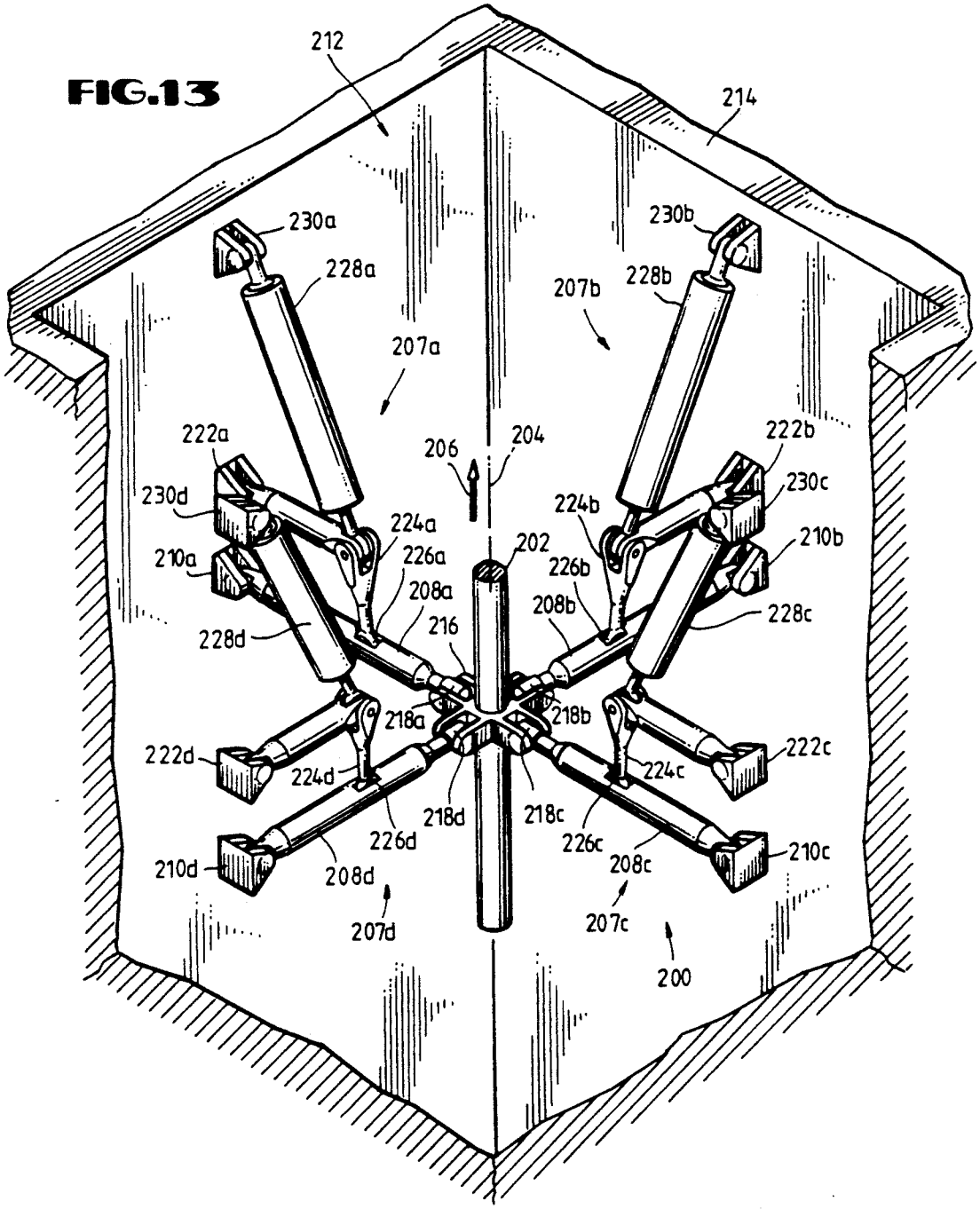
FIG. 13 is a perspective view of another alternate riser tensioner system in accordance with the present invention.

Referring now to FIG. 13, yet another embodiment of a variable spring rate riser tensioner system is illustrated and generally designated by a reference numeral 200. Again, similar elements of the system 200 are labelled with like reference numerals. The system 200 is adapted to provide a substantially constant upward force on a riser 202 to minimize undesirable compressive stress fluctuations in the riser 202. This upward force is aligned generally along the longitudinal axis 204 of the riser 202 in the direction of the arrow 206. The system 200 is constructed and operates quite similarly to the system 100 previously described. The system 200 includes a plurality of tensioning assemblies or arms 207a, 207b, 207c, 207d which are, preferably, disposed symmetrically about the longitudinal axis 204. Each assembly 207a–207d includes a respective lever 208a, 208b, 208c, and 208d. As in the system 100, the radially outward ends of the levers 208a–208d are pivotally connected by respective mounting brackets 210a, 210b, 210c, 210d to the inner walls of an opening 212 in a floating platform 214. Similarly, the radially inward ends of the levers 208a–208d are pivotally connected to a mounting bracket 216 which is fixedly connected to the cylindrical outer surface of the riser 202. Also, as in the system 100, the levers 208a–208d are connected to the mounting bracket 216 by respective motion compensation bearings 218a, 218b, 218c, 218d which allow the levers 208a–208d to slide axially in response to vertical excursions between the riser 202 and the platform 214.

The system 200 also includes a plurality of second levers 220a, 220b, 220c, 220d which are preferably located above the respective first levers 208a–208d. The radially outward ends of each of the levers 220a–220d are pivotally connected to respective inner walls of the opening 212 in the platform 214 by respective mounting brackets 220a, 220b, 220c, 220d. The radially inward ends of the levers 220a–220d are pivotally coupled to the respective levers 208–208d via respective connecting rods 224a, 224b, 224c, 224d. The upper end of each of the connecting rods 224a–224d is pivotally connected to the radially inward ends of the levers 220a–220d, and the lower end of each of the connecting rods 224a–224d is pivotally connected to the respective levers 208a–208d. As in the system 100, preferably, each of the levers 208a–208d includes a respective slot 226a, 226b, 226c, 226d which has a pin extending therethrough (not shown) in order to pivotally connect the connecting rods 224a–224d to the levers 208a–208d.

The system 200 further includes a plurality of springs 228a, 228b, 228c, 228d which cooperate with the respective levers 208a–208d and 220a–220d to exert a generally vertical force on the riser 202. As illustrated, an upper end of each of the springs 228a–228d is pivotally connected to respective inner walls of the opening 212 in the platform 214 by respective mounting brackets 230a, 230b, 230c, 230d. The opposite ends of each of the springs 228a–228d are pivotally coupled to the radially inward ends of the respective levers 220a–220d. Therefore, as the platform 214 moves upwardly with respect to the riser 202 in the direction of arrow 206, e.g., in response to a wave crest at sea, the levers 208a–208d and 220a–220d pivot downwardly and cause the springs 228a–228d to extend. Preferably, the springs 228a–228d increasingly compress as they extend. As in the system 100, the springs 228a–228d tend to become more vertically oriented as the levers 208a–208d and 220a–220d compress them. However, in contrast to the system 100, the addition of the levers 220a–220d alters the radial path that the springs 228a–228d follow as the system 200 strokes. Therefore, the system 200 may permit a greater range of vertical movement than the system 100, because the springs 228a–228d will not compress as much in response to a given amount of vertical movement between the riser and the platform.

The geometry in which the springs 228a–228d are connected to the levers 208a–208d, and the spring rate of the springs 228a–228d, determines the effective spring rate for the system 200. Therefore, these parameters are selected so that the vertical magnitude of the spring rate of the system 200 varies proportionally with the deflection of the system 200 as the riser 202 strokes. Thus selected, the system 200 will maintain a substantially constant upward force on the riser 202.

FIG. 14 illustrates a fourth alternate embodiment of a riser tensioning system and is generally designated by the reference number 300. To avoid confusion, similar elements of the system 300 will be labelled with like reference numerals. Like the previously discussed systems, the system 300 is adapted to mount between a riser 302 and a floating platform 304, and to apply an upward force along the longitudinal axis 306 of the riser 302 generally in the direction of the arrow 308. Preferably, the geometry and spring rate of the system 300 is selected so that the system 300 provides a substantially constant upward force to the riser 302. As will become apparent upon review of the subsequent discussion, the system 300 exhibits similarities to both the system 10 and the system 100.

The system 300 includes a plurality of levers 310a, 310b, 310c, 310d which are preferably disposed in a symmetrical fashion about the longitudinal axis 306 of the riser 302. The radially outward ends of the levers 310a–310d are pivotally coupled to respective inner walls of the opening 312 in the floating platform 304 by respective mounting brackets 314a, 314b, 314c, 314d. The radially inward ends of the levers 310a–310d are pivotally coupled by respective motion compensation bearings 318a–318d to a mounting bracket 316 which is fixed to the riser 302. The motion compensation bearings 318a–318d permit the levers 310a–310d to move along their respective longitudinal axes in response to the relative movement between the riser 302 and the platform 304. Therefore, the connection of the levers 310a–310d between the riser 302 and the platform 304 is virtually identical to the connection of the levers 110a–110d between the riser 102 and the platform 116 in the system 100.

The system 300 further includes a plurality of springs 320a, 320b, 320c, 320d which operate in compression throughout the range of motion of the system 300. One end of each of the springs 320a–320d is pivotally connected to an inner wall of the opening 312 in the platform 304 by a respective mounting bracket 322a, 322b, 322c, 322d. The opposite end of each of the springs 320a–320d is pivotally connected to its respective lever 310a–310d in the manner previously described with respect to the system 100. However, in contrast to the system 100, the springs 320a–320d extend below the levers 310a–310d rather than above them. As the platform 304 moves upwardly in the direction of arrow 308 with respect to the riser 302, the levers 310a–310d pivot downwardly.

FIG. 15 illustrates the movement of one lever 310 with the understanding that all of the levers 310a–310d move similarly. As each lever 310a–310d pivots downwardly, the length of the lever between the riser 302 and the spring 310a–310d increases. Moreover, the angle $\alpha$, between the riser 302 and the respective springs 310a–310d, increases as the springs 320a–320d shorten and compress. In this respect, the system 300 exhibits similarities to the system 10, in that the springs 320a–320d become more horizontally oriented as they compress. Thus, if each of the spring rates of the springs 320a–320d is visualized as a vector, the magnitude of the vertical component of each vector would decrease as the springs 320–320d compress.

Figure 16:
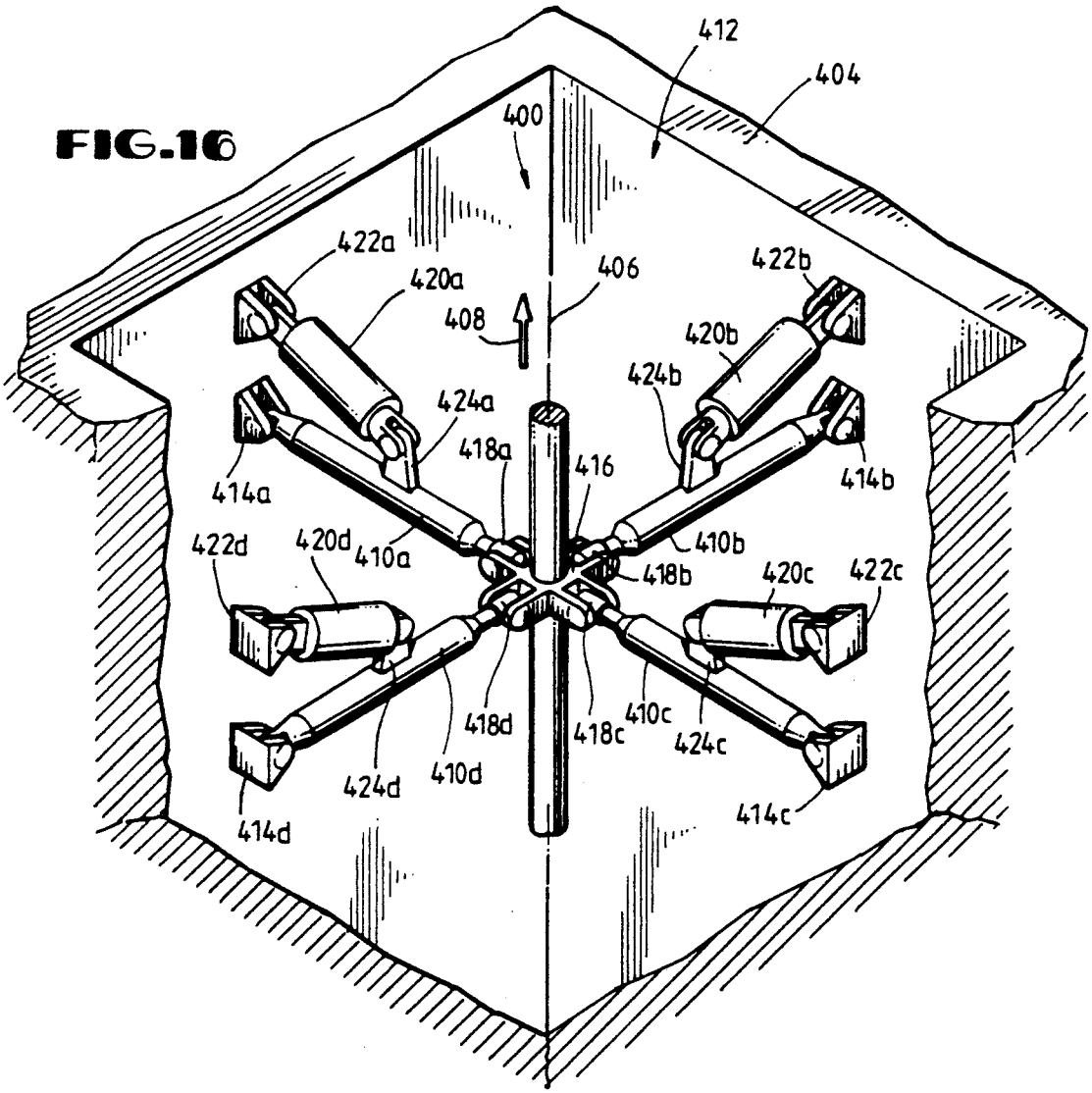
FIG. 16 is a perspective view of still another alternate riser tensioner system in accordance with the present invention.

FIG. 16 illustrates a fifth embodiment of a riser tensioner system which is generally designated by the reference numeral 400. As before, similar elements of the system 400 are labelled with like reference numerals. Like the previously described systems, the system 400 is adapted to connect a riser 402 to a floating platform 404, and to preferably apply a substantially constant force to the riser 402 along the longitudinal axis 406 of the riser 402 generally in the direction of the arrow 408. As will become apparent during the following discussion, the system 400 exhibits similarities to the systems 100 and 200.

The system 400 includes a plurality of levers 410a, 410, 410c, 410d, which are preferably disposed in a symmetrical fashion about the longitudinal axis 406. The radially outward end of each of the levers 410a–410d is pivotally connected to a respective inner wall of the opening 412 in the platform 404 by a respective mounting bracket 414a, 414b, 414c, 414d. The radially inward ends of each of the levers 410a–410d are pivotally coupled by respective motion compensation bearings 418*a*, 418*b*, 418*c*, 418*d* to a mounting bracket 416 which is fixedly connected to the outer cylindrical surface of the riser 402. Therefore, the levers 410*a*–410*d* may move along their respective longitudinal axes in response to vertical excursions between the riser 402 and the platform 404. In this respect, the levers 410*a*–410*d* are virtually identical to the levers described in conjunction with the systems 100 and 200.

The system 400 further includes a plurality of springs 420*a*, 420*b*, 420*c*, 420*d* which operate in compression throughout the range of movement of the system 400. One end of each of the springs 420*a*–420*d* is pivotally coupled to an inner wall of the opening 412 in the platform 404 by a respective mounting bracket 422*a*, 422*b*, 422*c*, 422*d*. The opposite ends of each of the springs 420*a*–420*d* are pivotally coupled to respective lugs 424*a*, 424*b*, 424*c*, 424*d*. Each lug 422*a*–422*d* is fixedly coupled to its respective lever 410*a*–410*d*, and extend a pre-determined distance above the lever.

Figure 17:
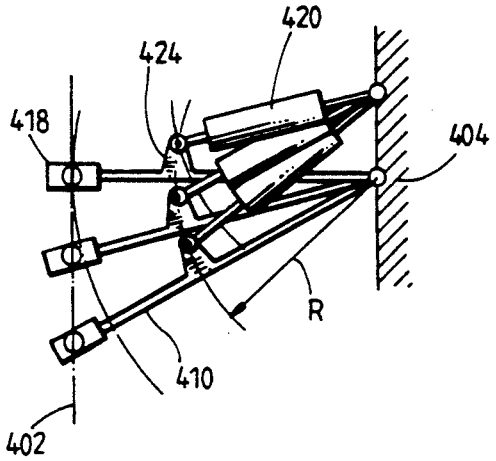
FIG. 17 is a diagrammatic view of the motion of one arm of the system illustrated in FIG. 16.

As illustrated in FIG. 17, as the platform 404 moves upwardly in the direction of arrow 408 with respect to the riser 402, the levers 410*a*–410*d* pivot downwardly. While the movement of only one spring and lever assembly is illustrated, it should be understood that all of the spring and lever assemblies will move similarly. As each lever 410*a*–410*d* pivots downwardly, each lug 422*a*–422*d* rotates about a fixed radius R, and the springs 420–420*d* extend and compress.

The springs 420*a*–420*d* do not extend by the same amount as the levers 410 extend between the riser 402 and the lugs 424. Therefore, as with the system 200, there can be a relatively large vertical excursion between the riser 402 and the platform 404 which corresponds to a relatively small stroke of the springs 420*a*–420*d*. In fact, the lugs 424*a*–424*d* may extend upwardly from the respective levers 410*a*–410*d* so that, in the rest position, the springs 420*a*–420*d* are substantially parallel to the levers 410*a*–410*d*. If the springs 420*a*–420*d* are relatively strong, i.e., their spring rates are relatively high, then they can exert a sufficient force in the direction of the arrow 408 throughout the range of motion of the system 400. By properly selecting the geometry of each of the levers and springs, and by properly selecting the spring rate of the springs 420*a*–420*d*, the force in the direction of the arrow 408 remains substantially constant.

Figure 18:
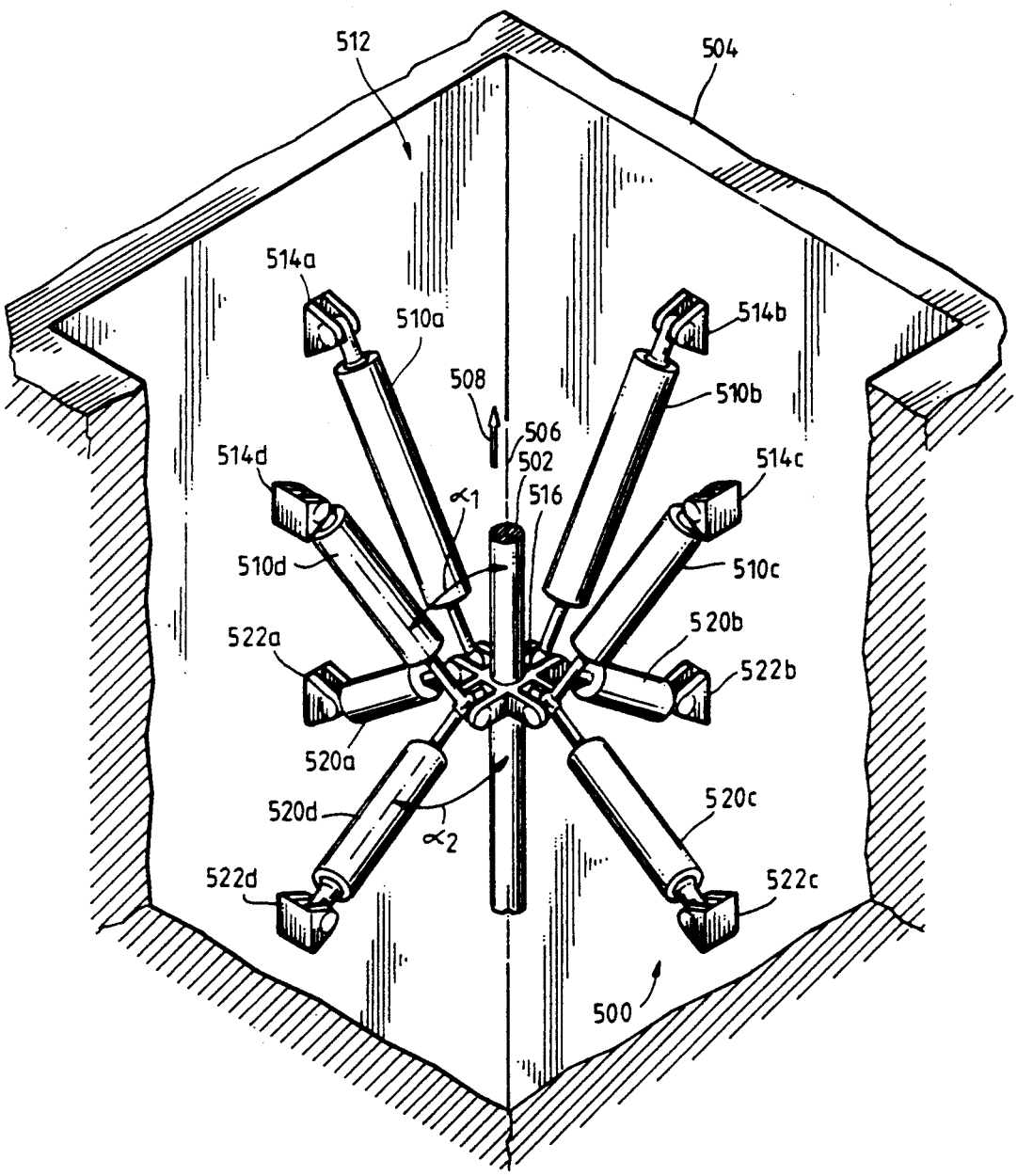
FIG. 18 is a perspective view of a further alternate riser tensioner system in accordance with the present invention.

The vertical spring constant of a riser tensioner system can also be varied to maintain a constant tensioning force on a riser without using levers. FIG. 18 illustrates such an embodiment of a riser tensioner system which is generally designated by the reference numeral 500. As before, similar elements of the system 500 are labelled with like reference numerals. Like the previously described systems, the system 500 is adapted to connect a riser 502 to a floating platform 504, and to preferably apply a substantially constant force to the riser 502 along the longitudinal axis 506 of the riser 502 generally in the direction of the arrow 508.

The system 500 includes a plurality of upper springs 510*a*, 510, 510*c*, 510*d*, which are preferably disposed in a symmetrical fashion about the longitudinal axis 506. The radially outward end of each of the upper springs 510*a*–510*d* is pivotally connected to a respective inner wall of the opening 512 in the platform 504 by a respective mounting bracket 514*a*, 514*b*, 514*c*, 514*d*. The radially inward end of each of the upper springs 510*a*–510*d* is pivotally coupled to a mounting bracket 516 which is fixedly connected to the outer cylindrical surface of the riser 502.

The system 500 further includes a plurality of lower springs 520*a*, 520*b*, 520*c*, 520*d* which are also disposed in a symmetrical fashion about the longitudinal axis 506. One end of each of the lower springs 520*a*–520*d* is pivotally coupled to an inner wall of the opening 512 in the platform 504 by a respective mounting bracket 522*a*, 522*b*, 522*c*, 522*d*. The opposite ends of each of the lower springs 520*a*–520*d* are pivotally coupled to the mounting bracket 516.

As the platform 504 moves in the direction of arrow 508 relative to the riser 502, the angle $\alpha_1$, between the upper springs 510*a*–510*d* and the riser 502, decreases, and the angle $\alpha_2$, between the lower springs 520*a*–520*d* and the riser 502, increases. In other words, the upper springs 510*a*–510*d* become more vertically oriented, and the lower springs 520*a*– 520*d* become more horizontally oriented. Thus, as the riser strokes, the vertical magnitude of the spring rate $k_u$ for the upper springs increases and the vertical magnitude of the spring rate $k_L$ for the lower springs decreases.

Like the previously described systems, the springs 510*a*–520*d* preferably remain in compression throughout the range of movement between the riser 502 and the platform 504. Therefore, the upper springs 510*a*–510*d* compress as they extend in response to the upward movement of the platform 504, and the lower springs 520*a*–520*d* compress as they retract in response to the upward movement of the platform.

A spring rate having a vertical magnitude that decreases when the riser stroke causes the springs 510*a*–520*d* to compress may be obtained by properly selecting the angles $\alpha_1$ and $\alpha_2$ and the spring rates $k_u$ and $k_L$ of the upper and lower springs. For instance, if the angles $\alpha_1$ and $\alpha_2$ are equal, then $k_L$ should be greater than $k_u$. If so, then as the platform 504 moves upwardly with respect to the riser 502, the vertical component of $k_u$ increases and the vertical component of $k_L$ decreases. Since the vertical component of $k_L$ decreases more rapidly than the vertical component of $k_u$, the overall vertical spring rate for the system 500 decreases as the riser 502 strokes. Thus, by properly selecting the spring rates $k_u$ and $k_L$, the system 500 maintains a substantially constant force on the riser 502 throughout the expected stroke of the riser 502.

What is claimed is:

1. A riser tensioner system for applying a tensioning force to a riser and allowing a floating platform to move within a preselected range along a longitudinal axis of said riser, said system comprising:

a spring and a lever forming an assembly, said assembly being coupled to said riser and to said platform, said spring having a spring rate, said lever being coupled to said spring to control orientation of said spring relative to said riser to response to relative movement between said platform and said riser along said longitudinal axis, thereby controllably varying a magnitude of a vertical component of said spring rate in proportion to said relative movement such that said tensioning force remains substantially constant through said range.

2. The system, as set forth in claim 1, further comprising:

a plurality of spring and lever assemblies being symmetrically disposed about said longitudinal axis of said riser, each of said assemblies being coupled to said riser and to said platform, each of said springs remaining in compression throughout said range and each of said springs having a spring rate, each of said levers being coupled to a respective spring and to at least one of said riser and said platform to control orientation of said respective spring relative to said riser in response to movement between said platform and said riser along said longitudinal axis, thereby controllably varying a magnitude of a vertical component of said spring rate of each of said springs in proportion to said relative movement so that said tensioning force remains substantially constant through said range.

3. A riser tensioner system for applying a tensioning force to a riser and allowing a floating platform to move within a preselected range along a longitudinal axis of said riser, said system comprising:

a spring having a first end and a second end, said first end being pivotally coupled to said floating platform, said spring having a preselected spring rate;

a lever having a first end and a second end, said first end of said lever being pivotally coupled to said floating platform, and said second end of said lever being pivotally coupled to said riser;

said second end of said spring being pivotally coupled to a preselected location on said lever, thus forming an angle between a longitudinal axis of said spring and the longitudinal axis of said riser, said angle determining a verical magnitude of said spring rate;

said lever varying said vertical magnitude of said spring rate in proportion to movement of said platform so that said tensioning force remains substantially constant through said range.

4. The system, as set forth in claim 3, wherein said spring remains in compression throughout said range.

5. The system, as set forth in claim 3, further comprising:

a plurality of springs each having a first end and a second end and each spring having a preselected spring rate, said first end of each spring being pivotally coupled to said floating platform;

a plurality of levers each having a first end and a second end, said first end of each lever being pivotally coupled to said floating platform, and said second end of each lever being pivotally coupled to said riser;

said second end of each spring being pivotally coupled to a preselected location on one of said respective levers, thus forming an angle between a longitudinal axis of said spring and the longitudinal axis of said riser, said angle determining a vertical magnitude of said spring rate for said respective spring;

each lever varying said vertical magnitude of said spring rate of said respective spring in proportion to movement of said platform so that said tensioning force remains substantially constant through said range.

6. The system, as set forth in claim 5, further comprising:

a plurality of motion compensation bearings being pivotally coupled to said riser, each of said bearings being slidably coupled to one of said second ends of said plurality of respective levers.

7. The system, as set forth in claim 6, wherein:

said first end of each of said springs is coupled to said platform below said first end of each of said respective levers, whereby movement between said riser and said platform in a first direction causes each of said springs to increasingly compress and each of said angles to increase, and movement between said riser and said platform in a second direction opposite said first direction causes each of said springs to decreasingly compress and each of said angles to decrease.

8. The system, as set forth in claim 6, wherein:

said first end of each of said springs is coupled to said platform above said first end of each of said respective levers, whereby movement between said riser and said platform in a first direction causes each of said springs to increasingly compress and each of said angles to decrease, and movement between said riser and said platform in a second direction opposite said first direction causes each of said springs to decreasingly compress and each of said angles to increase.

9. The system, as set forth in claim 6, further comprising:

a plurality of lugs, one of said plurality of lugs extending outwardly from each respective lever, said second end of each of said springs being pivotally coupled to said respective lug.

10. The system, as set forth in claim 9, wherein:

said first end of each of said springs is coupled to said platform above said first end of each of said respective levers, whereby movement between said riser and said platform in a first direction causes each of said springs to increasingly compress and each of said angles to decrease, and movement between said riser and said platform in a second direction opposite said first direction causes each of said springs to decreasingly compress and each of said angles to increase.

11. The system, as set forth in claim 6, wherein each of said levers comprises:

a plurality of first arms, each of said first arms having a first end and a second end, said first end of each of said first arms being pivotally coupled to said platform and said second end of each of said first arms being pivotally coupled to said riser; and a plurality of second arms, each of said second arms having a first end and a second end, said first end of each of said second arms being pivotally coupled to said platform and said second end of each of said second arms being pivotally coupled to said first arms.

12. The system, as set forth in claim 11, wherein:

said second end of each spring is pivotally coupled to said second end of each of said respective second arms.

13. The system, as set forth in claim 12, further comprising:

a plurality of connecting arms, each of said connecting arms having a first end and a second end, said first end of each of said connecting arms being pivotally coupled to said second end of each of said respective second arms, and said second end of each of said connecting arms being pivotally coupled to a preselected location on each of said respective first arms.

14. A riser tensioner system comprising:

a first spring having a first end and a second end, said first end being pivotally coupled to a riser and forming a first angle between a longitudinal axis of said first spring and a longitudinal axis of said riser;

a second spring having a first end and a second end, said first end of said second spring being pivotally coupled to said second end of said first spring to form a junction, and said second end of said second spring being pivotally coupled to a floating platform and forming a second angle between a longitudinal axis of said second spring and said longitudinal axis of said riser;

a lever having a first end and a second end, said first end of said lever being pivotally coupled to said floating platform, and said second end of said lever being pivotally coupled to said junction;

said first and second springs being adapted to increasingly compress in response to said platform moving relatively to said riser along said longitudinal axis of said riser in a first direction, whereby movement in said first direction causes said first and second angles to increase; and said first and second springs being adapted to decreasingly compress in response to said platform moving relatively to said riser along said longitudinal axis of said riser in a second direction, whereby movement in said second direction causes said first and second angles to decrease.

15. A method for applying a tensioning force to a riser while allowing limited movement between the riser and a floating platform, comprising the steps of:

pivotally coupling a first end of a first compression spring to said riser and forming a first angle between a longitudinal axis of said first compression spring and a longitudinal axis of said riser, said first compression spring having a first spring rate having a vertical magnitude being determined by said first angle;

pivotally coupling a second end of said first compression spring to a first end of a second compression spring to form a junction and to form a second angle between a longitudinal axis of said second compression spring and said longitudinal axis of said riser, said second compression spring having a second spring rate having a vertical magnitude being determined by said second angle;

pivotally coupling a second end of said second compression spring to said platform; and pivotally coupling a first end of a lever to said platform;

pivotally coupling a second end of a lever to said junction; and decreasing said vertical magnitude of said first and second spring rates in proportion to said movement by increasing said first and second angles when said movement causes said respective first and second springs to compress so that said tensioning force remains substantially constant.

16. A method for applying a tensioning force to a riser while allowing limited movement between the riser and a floating platform, comprising the steps of:

pivotally coupling a first end of a lever to said platform;

pivotally coupling a second end of said lever to said riser;

pivotally coupling a first end of a compression spring to said platform and forming an angle between a longitudinal axis of said compression spring and a longitudinal axis of said riser, said compression spring having a spring rate having a vertical magnitude being determined by said angle; and pivotally coupling a second end of said compression spring at a preselected location on said lever so that vertical movement in a first direction between said riser and said platform causes said compression spring to increasingly compress and said angle to increase.

17. The method, as set forth in claim 16, wherein said step of coupling said first end of said compression spring to said platform is accomplished by:

coupling said first end to a mounting bracket being fixedly coupled to said platform at a location below said first end of said lever.

18. A method for applying a tensioning force to a riser while allowing limited movement between the riser and a floating platform, comprising the steps of:

pivotally coupling first ends of a plurality of levers to said platform;

pivotally coupling second ends of said plurality of levers to said riser;

pivotally coupling first ends of a like plurality of compression springs to said platform and forming an angle between a longitudinal axis of each of said compression springs and a longitudinal axis of said riser, each of said compression springs having a spring rate having a vertical magnitude being determined by said respective angle; and pivotally coupling second ends of said plurality of compression springs at a preselected location on said respective levers, whereby movement in a first direction between said riser and said platform causes each of said compression springs to increasingly compress and each of said angles to increase.

19. The method, as set forth in claim 18, wherein said step of coupling said first ends of said compression springs to said platform is accomplished by:

coupling each of said first ends to a respective mounting bracket being fixedly coupled to said platform at a location below said first ends of said respective levers.

20. The method, as set forth in claim 18, wherein the step of pivotally coupling said second ends of said plurality of levers to said riser is accomplished by:

pivotally coupling a plurality of motion compensation bearings to said riser; and slidably coupling each of said second ends of said plurality of levers to one of said respective motion compensation bearings.

21. A riser tensioner system for applying a tensioning force to a riser and allowing a floating platform to move within a preselected range along a longitudinal axis of said riser, said system comprising:

a spring assembly being adapted for coupling said rise to said platform and having a preselected spring rate, said assembly being configured for varying a magnitude of a vertical component of said spring rate in proportion to movement of said platform such that said tensioning force remains substantially constant throughout said range, wherein said spring assembly comprises:

a first spring having a first end and a second end, said first end being pivotally coupled to said platform and said second end being pivotally coupled to said riser; and a second spring having a first end and a second end, said first end of said second spring being pivotally coupled to said platform at a location below said first end of said first spring and said second end of said second spring being pivotally coupled to said riser.

22. The system, as set forth in claim 21, wherein:

said first spring has a first spring rate and said second spring has a second spring rate, each of said spring rates having a vertical component along said longitudinal axis of said riser.

23. The system, as set forth in claim 22 wherein:

movement between said riser and said platform in a first direction causes said first and second springs to pivot relative to said riser such that a sum of said vertical components of said first and second spring rates varies directly with and inversely proportional to said movement.

24. The system, as set forth in claim 21, further comprising:

a plurality of spring assemblies being symmetrically disposed about said longitudinal axis of said riser and coupling said riser to said platform, said assemblies having springs which remain in compression throughout said range and define a spring rate for said system, said assemblies being configured for varying a magnitude of a vertical component of said spring rate in proportion to movement of said platform such that said tensioning force remains substantially constant throughout said range.

25. A riser tensioner system for applying a tensioning force to a riser and allowing a floating platform to move within a preselected range along a longitudinal axis of said riser, said system comprising:

spring means for providing said tensioning force, said spring means having a predetermined spring rate and being coupled to said platform and to said riser; and lever means for controllably varying a vertical component of said predetermined spring rate by controlling orientation of said spring means relative to said riser in response to relative movement between said riser and said platform along said longitudinal axis, said lever means being coupled to said spring means and to at least one of said riser and said platform.

26. A riser tensioner system for applying a tensioning force to a riser and allowing a floating platform to move within a preselected range along a longitudinal axis of said riser, said system comprising:

spring means for providing said tensioning force, said spring means having a predetermined spring rate and being coupled to at least one of said platform and said riser; and lever means for controllably varying a vertical component of said predetermined spring rate by controlling orientation of said spring means relative to said riser in response to relative movement between said riser and said platform along said longitudinal axis, said lever means being coupled to said spring means and to said riser and said platform.

* * * * *

UNITED STATES PATENT AND TRADEMARK OFFICE

CERTIFICATE OF CORRECTION

PATENT NO. : 5,160,219

DATED : November 3, 1992

INVENTOR(S) : Edward J. Arlt

It is certified that error appears in the above-indentified patent and that said Letters Patent is hereby corrected as shown below:

On the title page, item [75], the listed inventors should be: --Edward J. Arlt, Fort Worth, Tex.; Gary L. Whightsil, Kennedale, Tex.; and Charles J. Moses, Alvarado, Tex.--

Column 6, line 33, "1o" should be --10--.

Column 9, line 53, "Vertical" should be --vertical--.

Column 11, line 23, "14" should be -- - --.

Column 11, line 37, after "course," add --it can--.

Column 16, line 4, after "also" add --preferably--.

Signed and Sealed this

Tenth Day of May, 1994

*Attest:*

*Attesting Officer*

BRUCE LEHMAN

*Commissioner of Patents and Trademarks*